United States Patent [19]

Dubreux et al.

[11] Patent Number: 4,699,623

[45] Date of Patent: Oct. 13, 1987

[54] PROCESS OF BLEACHING LAUNDRY

[75] Inventors: Bernard Dubreux, Francheville le Bas; Yann Dugenet, Issy les Moulineaux, both of France

[73] Assignee: Atochem, France

[21] Appl. No.: 799,027

[22] Filed: Nov. 18, 1985

[30] Foreign Application Priority Data

Nov. 21, 1984 [FR] France ..... 84 17940

[51] Int. Cl.[4] ..... C11D 7/54; D06L 3/02; D06L 3/16

[52] U.S. Cl. ..... 8/111; 252/103; 252/186.25; 252/186.28; 252/186.3; 252/186.43

[58] Field of Search ..... 252/99, 186.42, 186.43, 252/103, 186.25, 186.27, 186.28, 186.30; 8/111

[56] References Cited

U.S. PATENT DOCUMENTS

| | | | |
|---|---|---|---|
| 2,691,636 | 10/1954 | Strayner | 252/152 |
| 2,766,212 | 10/1956 | Grifo | 252/152 |
| 2,908,651 | 10/1959 | Grifo | 252/153 |
| 3,332,880 | 7/1967 | Kessler et al. | 252/536 |
| 3,384,596 | 5/1968 | Moyer | 252/103 |
| 3,740,187 | 6/1975 | Kowalski | 8/111 |
| 3,766,078 | 10/1973 | Kowalski | 252/186 |
| 3,770,816 | 11/1973 | Nielsen | 260/502 R |
| 3,795,625 | 3/1974 | Kowalski | 252/186 |
| 3,957,695 | 5/1976 | Davies et al. | 252/532 |
| 4,022,702 | 5/1977 | Curtis | 252/89 R |
| 4,086,177 | 4/1978 | Kubitschek et al. | 252/102 |
| 4,129,515 | 12/1978 | Fosler | 252/117 |
| 4,170,453 | 10/1979 | Kitko | 8/111 |
| 4,208,295 | 1/1980 | Sai et al. | 252/94 |
| 4,514,185 | 4/1985 | Lee et al. | 8/137 |
| 4,522,739 | 6/1985 | Gray | 252/95 |

FOREIGN PATENT DOCUMENTS

| | | |
|---|---|---|
| 0086511 | 8/1983 | European Pat. Off. . |
| 2532866 | 1/1977 | Fed. Rep. of Germany . |
| 2140213 | 1/1973 | France . |

*Primary Examiner*—Paul Lieberman
*Assistant Examiner*—Linda D. Skaling
*Attorney, Agent, or Firm*—Sigalos & Levine

[57] ABSTRACT

The invention involves a process for bleaching domestic laundry in a domestic washing cycle, comprising prewashing the laundry in an alkaline bath with pH between 9 and 13 and at a temperature between about 40° C. to 70° C. in the presence of at least one peroxide bleaching agent and an uncomplexed calcium, said calcium being present in an amount between about 0.002% to 1% by weight of the bath.

6 Claims, No Drawings

PROCESS OF BLEACHING LAUNDRY

BACKGROUND OF THE INVENTION

This invention pertains to bleaching of domestic laundry in a household washing cycle comprising a prewash followed by rinsing and washing operation.

In the field of detergents, the per-salts, in particular sodium perborate, are the most widely used bleaching agents, but are also uneconomical sources of active oxygen.

These per-salts or peroxyhydrates are sufficiently active at temperatures of less than approximately 70° C. only in the presence of compounds called activators, which significantly increase the cost of the bleaching compositions which contain them in addition to or without detergent agents.

SUMMARY OF THE INVENTION

The process according to the invention makes it possible to improve the bleaching effect of such compositions.

The invention involves the process of performing the prewash in a conventional household washing cycle comprising an alkaline-bath prewash with a pH between about 9 and 13 at a temperature of between about 40° C. to 70° C. in the presence of at least one peroxide bleaching agent and a quantity of uncomplexed calcium between 0.002 and 1% by weight of the bath, followed by the conventional rinsing and washing operations of known cycles.

DETAILED DESCRIPTION

The calcium can be introduced into the prewash bath by, for example, dissolving therein calcium oxide [CaO] or calcium hydroxide [$Ca(OH)_2$].

It is preferably introduced by adding to the prewash bath a calcium salt whose anion is inert with respect to the peroxide bleaching agent and whose dissociation constant is greater than 0.01. Calcium chloride, for example, meets this requirement particularly well.

The preferred quantity of uncomplexed calcium is between 0.005% and 0.1% of the weight of the bath.

The peroxide bleaching agent present in the prewash bath is selected from those commonly employed in bleaching baths for bleachable stains on domestic laundry or from the so-called complete detergent compositions which perform this same function, such as hydrogen peroxide, sodium perborate, sodium percarbonate or urea peroxyhydrate. The active oxygen concentration resulting from the presence of such bleaching agents is generally between 0.004% and 0.03% of the weight of the bath.

The prewash bath can contain agents which complex metal ions, in particular ions of the alkaline earth metals, but in quantities such that the quantity of uncomplexed calcium in the bath, which characterizes said bath, is maintained.

The prewash bath can also contain, in nature and in quantity, the detergent products and other ingredients usually present in a conventional prewash which begins a known domestic washing cycle.

Finally, the prewash can consist solely of a mixture, in an aqueous environment, of the alkaline agent, the peroxide bleaching agent and the salt selected to be the source of calcium.

In a similar case, the prewash bath preferably contains calcium and the alkaline agent in the ratio which would correspond to the formation of $Ca(OH)_2$.

The preferred alkaline agent is sodium hydroxide [NaOH], but the product which is the calcium source can be the cause, totally or partly, of the alkalinity of the bath when it is selected from calcium oxide or calcium hydroxide.

The preferred pH range is between 10.5 and 12.5.

The temperature range between 40° C. and 70° C. is preferred for implementation of the invention, since at temperatures below 40° C., the invention only results in an insignificant improvement in bleaching effect, and at temperatures above 70° C., it leads to a rapidly prohibitive expenditure of energy.

The duration of the prewash largely depends on the other conditions under which this operation is effected. In the invention, it is analogous to that of a conventional prewash and is thus generally less than one hour.

The invention will be further described in connection with the following examples which are set forth for purposes of illustration only.

For the tests set forth in the examples:

(i) the term "washing soap" designates the standardized powdered EMPA washing soap with the following composition by weight:
$Na_2SiO_3$: 5.34%,
$Na_2SO_4$: 7.25%,
$Na_2CO_3$: 2.65%,
$Na_2HPO_4$: 0.96%,
$Na_4P_2O_7$: 3.99%,
$Na_5P_3O_{10}$: 30.41%,
$NaPO_3$: 11.92%,
$H_2O$: 18.90%,
Surfactants: 14.00%,
Bluing agents, other: 4.58%, (ii) the prewash and washing operations are conducted in an AHIBA G VI B water-bath, (iii) the weight ratio between bath and material for bleaching is approximately equal to 20, (iv) the material for bleaching is a standarized EMPA fabric stained with wine or tea, (v) the bleaching effect is defined by the difference between the white indices before and after application of the washing cycle or the change in white compared as a percentage to a maximum white of 100, according to the formula:

$$\text{bleaching effect} = \frac{\text{change in white}}{100 - \text{initial white}} \times 100$$

Measurements were made with an Elrepho spectrophotometer made by the Carl Zeiss Company with a No. 6 filter, (vi) the domestic washing cycles, for which the prewash and washing cycles are defined in the examples solely by their plateau temperatures, comprising for each of these stages a steady-state duration of 30 minutes and a time to steady-state temperature of 20 minutes from the anbient temperature of approximately 20° C., and (vii) after prewashing and washing, the treated fabric is removed from the bath, drained, and rinsed for five minutes in water at room temperature.

EXAMPLE 1

A domestic washing cycle is conducted, in which the temperature conditions and the composition of the aqueous prewash bath are as follows:

Temperature: 60° C.,

Hydrogen peroxide $H_2O_2$: 0.022%,

Calcium: 0.027%, introduced in the form of $Ca(OH)_2$.

The bath did not contain any agent to complex the calcium ions.

The bleaching effect measured after washing at 60° C. in a bath consisting of water and 0.67% washing soap was 28.5% in the case of tea and 51% in the case of wine.

When test No. 1 was repeated in the absence of calcium but in the presence of a quantity of sodium hydroxide creating the same pH conditions during the prewash, the bleaching effect was only 25.5% in the case of tea and 48.4 in the case of wine.

EXAMPLE 2

Test No. 1 was repeated with the prewash conducted in the presence of 0.054% calcium.

The final bleaching effect measured was 34% in the case of tea and 52.5% in the case of wine.

This bleaching effect under pH conditions for the prewash bath similar to those prevailing in the presence of sodium hydroxide but in the absence of calcium was only 31.7% in the case of tea and 50% in the case of wine.

EXAMPLE 3

When the prewash is conducted as in the preceding examples, but in the presence of three times more calcium than in Example 1, introduced in the form of $CaCl_2$ and accompanied by the quantity of sodium hydroxide corresponding to the formation of $Ca(OH)_2$, the bleaching effect measured on the fabric at the end of the cycle was 33.5% for tea and 55% for wine.

In the absence of calcium in the bath, but in the presence of a quantity of NaOH sufficient to create similar pH conditions during the prewash, the final observed bleaching effect for tea was 33%, which is close to that measured in the presence of calcium, but only 50.5% for wine, which is much less than the effect observed in the presence of calcium.

EXAMPLE 4

A domestic washing cycle is conducted with a prewash performed under the following conditions of temperature and composition of the aqueous alkaline bath:

Temperature: 60° C.,

Washing soap: 0.47%,

Sodium perborate tetrahydrate: 0.10%,

Sodium hydroxide NaOH: 0.076%,

Calcium in uncomplexed form: 0.038%, introduced in the form of $CaCl_2$.

The rest of the cycle was conducted as in the preceding examples.

The bleaching effect measured at the end of the cycle was 23.5% in the case of tea and 47% in the case of wine.

Under the same conditions as above, but in the absence of calcium, the bleaching effect was only 20.5% for tea and 31% for wine.

EXAMPLE 5

A domestic washing cycle was conducted, in which the conditions of temperature and composition of the aqueous alkaline prewash bath were as follows:

Temperature: 60° C.,

Hydrogen peroxide $H_2O_2$: 0.033%,

Sodium hydroxide NaOH: 0.108%,

Calcium: 0.054%, introduced in the form of $CaCl_2$.

At the end of the cycle, which comprised a washing step as in the preceding examples, the bleaching effect measured for tea was 38% and 59.5% for wine.

The bleaching effect observed in the case of wine is still 47% when the quantity of hydroxide present in the prewash bath is only 0.037%, which produces a pH in said bath at the end of the prewash of barely 9. In a process according to the invention, a high bleaching effect is obtained even at weakly alkaline pH; i.e., under conditions which allow the cellulose support to retain its strength.

EXAMPLE 6

Example 5 was repeated, but with a prewash bath temperature of 45° C. rather than 60° C., meaning that the time to reach steady-state temperature was 12 minutes.

At the end of the cycle, the bleaching effect for tea was 30.7% and 47.5% for wine. The bleaching effect under the same conditions but in the absence of calcium was 28.5% for tea and 46.7% for wine.

Therefore, the improvement caused by the presence of calcium in the prewash bath remains appreciable even at a low temperature.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A process for bleaching domestic laundry in a domestic washing cycle, comprising prewashing the laundry in an alkaline bath with pH between 9 and 13 and at a temperature between about 40° C. to 70° C. in the presence of at least one peroxide bleaching agent selected from a hydrogen peroxide, a sodium perborate, a sodium percarbonate, or a urea peroxyhydrate and an uncomplexed calcium, said calcium being selected from calcium oxide, calcium hydroxide, or a calcium salt whose anion is inert with respect to the peroxide bleaching agent and whose dissociation constant is greater than 0.01 and said calcium present in an amount about 0.002% to 1% by weight of the bath.

2. The process of claim 1, wherein said calcium salt is calcium chloride.

3. The process of claims 1, or 2, wherein the quantity of calcium in the prewash bath is between 0.005% and 0.1% by weight of said bath.

4. The process of claims 1, or 2, wherein the prewash bath contains agents which complex alkaline earth metals.

5. The process of claims 1, or 2, wherein the prewash bath contains sodium hydroxide.

6. The process of claims 1, or 2, wherein the pH of the prewash bath is between about 10.5 and 12.5.

* * * * *